US006343734B1

(12) United States Patent
Smith

(10) Patent No.: US 6,343,734 B1
(45) Date of Patent: Feb. 5, 2002

(54) GIFT WRAP AND METHOD OF WRAPPING

(76) Inventor: Linda A. Smith, 994 Millard Rd., Stone Mountain, GA (US) 30088

( * ) Notice: Subject to any disclaimer, the term of this patent is extended or adjusted under 35 U.S.C. 154(b) by 0 days.

(21) Appl. No.: 09/440,971

(22) Filed: Nov. 16, 1999

Related U.S. Application Data

(60) Provisional application No. 60/127,141, filed on Mar. 31, 1999.

(51) Int. Cl.[7] ..... B65D 65/38
(52) U.S. Cl. ..... 229/87.19
(58) Field of Search ..... 229/87.19

(56) References Cited

U.S. PATENT DOCUMENTS 683,294 A * 9/1901 Karr ..... 229/103.3
2,364,297 A * 12/1944 James ..... 229/87.19
2,527,685 A * 10/1950 Roush ..... 229/87.19
3,064,876 A * 11/1962 Warner ..... 229/87.19 X
RE26,742 E * 12/1969 Laskow ..... 229/87.19
4,228,947 A * 10/1980 Eroyan ..... 229/87.19 X
5,364,015 A * 11/1994 Hirschey ..... 229/87.19 X
5,971,264 A * 10/1999 Karahoca ..... 229/87.19 X

FOREIGN PATENT DOCUMENTS

JP 402004658 A * 1/1990 ..... 229/87.01

* cited by examiner

*Primary Examiner*—Jes F. Pascua
(74) *Attorney, Agent, or Firm*—Todd Deveau; Ryan A. Schneider; Troutman Sanders LLP

(57) ABSTRACT

The present invention relates to pre-cut wrapping paper having peel-and-stick adhesive strips, which wrapping paper can be sized and cut to foldably wrap a variety of packages while limiting waste wrap. The paper can be used to cover and prepare boxed and unboxed items for presentation. The peel-and-stick adhesive strips secure the sheet to the gift, thus removing the need for a roll of tape.

19 Claims, 3 Drawing Sheets

GIFT WRAP AND METHOD OF WRAPPING

This application claims benefit of Prov. No. 60/127,141 filed Mar. 31, 1999.

BACKGROUND OF THE INVENTION

1. Field of the Invention

The present invention relates generally to wrapping paper, or gift-wrap, and relates more specifically to pre-cut wrapping paper having peel-and-stick adhesive strips, which wrapping paper can be sized and cut to foldably wrap a variety of packages. The wrapping paper can be used to cover and prepare boxed and unboxed items for presentation.

2. Description of Related Art

Gift wrap comes in a variety of styles covering everyone's taste. Typically, one purchases gift-wrap in the form of a continuous roll of paper. A large amount of this paper is then wasted when wrapping a gift in the amount of overlap of the paper when folded around the gift, or when cut by scissors to a size to properly wrap around the gift.

Further, after completing the wrapping and folding of the paper around the gift, one must search for a roll of tape, and then tape the edges of the paper to the gift or to other portions of the paper (and then hide these taped edges) so the wrapping job looks professional and neat. This conventional gift wrapping effort has several more disadvantages. When wrapping a gift with too large a piece of paper, creases and bumps can show through the paper, producing an unsightly outward appearance to the gift wrap. Additionally, the conventional method is unsafe for children who cannot be trusted with scissors. Similarly, adults with visual or physical impairments can have difficulty using scissors or folding and taping the paper at the same time.

Therefore, it can be seen that a need yet exists for self-stick wrapping paper that is easy to use. A need further exists for gift wrap that limits waste. It is to the provision of such wrapping paper and a method of wrapping a gift, that the present invention is primarily directed.

BRIEF SUMMARY OF THE INVENTION

Briefly described, in its preferred form, the present wrapping paper is designed to wrap a gift box, and comprises a bottom panel, first and second end panels, and first and second side panels. It will be understood that throughout the present disclosure, references to the terms "wrap", "gift-wrap", "wrapping paper" and "sheet of wrap", among others, are interchangeable as describing the material of the present invention. The wrapping, sheet preferably is constructed from a sheet of material that easily can be folded, including, but not limited to, paper, plastic, foil, laminate, or a combination of these materials.

The wrapping paper is die-cut, according to known techniques. The sheet can further comprise adhesive zones located on some or all of the panels making up sheet. The adhesive zones provide a convenient way to secure the wrap around the box.

Accordingly, it is an object of the present invention to provide gift wrap that eliminates the need for scissors and sealing tape.

It is another object of the present invention to provide gift wrap that is safe for children and adults with visual and physical impairments to use.

Still another object of the present invention is to provide wrapping paper that includes self-stick strips.

Yet another object of the present invention is to provide wrapping paper that is pre-cut so there is little or no waste when wrapping a gift.

These and other objects, features and advantages of the present invention will become more apparent upon reading the following specification in conjunction with the accompanying drawing figures.

DETAILED DESCRIPTION OF A PREFERRED EMBODIMENT

Briefly described, in its preferred form, the present invention provides a sheet of wrapping paper for wrapping around a gift box or container, which wrapping paper is constructed from a flat, die-cut sheet. The sheet can further be scored to provide convenient fold lines. The present wrapping paper can further incorporate adhesive zones so that once a panel of the wrapping paper is foldably engaged with an end or side wall of the gift box, the panel is conveniently secured to a wall of the gift box, or to another panel of the gift-wrap. Preferably the adhesive zones comprise peel-and-stick assemblies.

The Wrap

Figure 1:
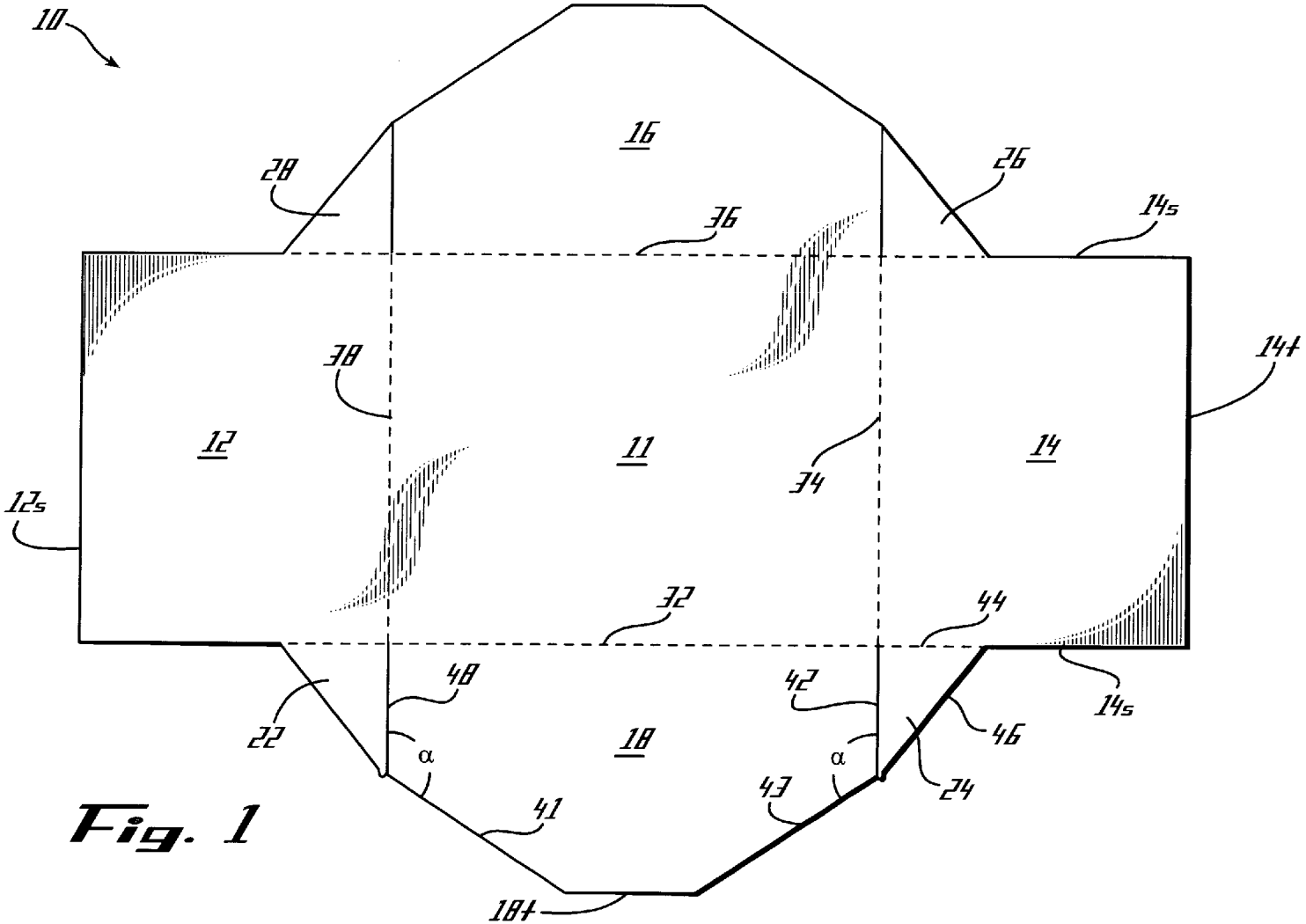
FIG. 1 shows the gift wrap of the present invention, according to a preferred embodiment.

Referring now in detail to the drawing figures, wherein like reference numerals represent like parts throughout the several views, FIG. 1 illustrates wrapping sheet 10 having a bottom panel 11, first and second end panels 12, 14, and first and second side panels 16, 18. The sheet 10 has a top and bottom face. The top face of the gift wrap 10 will be placed adjacent the walls of the container upon wrapping. The bottom face will be the exterior portion of the wrap that provides the outer appearance of the gift-wrap. The wrapping sheet 10 preferably is constructed from a sheet of material that easily can be folded. The sheet 10 is die-cut, according to known techniques, from a sheet of material.

The sheet 10 comprises a bottom panel 11 bounded by first and second side score lines 36, 32, and first and second end score lines 38, 34, respectively. The bottom panel 11 can take numerous shapes, and is designed to approximate the size of the bottom of the container or box to be wrapped. Generally, such containers, like shirt boxes, jewelry boxes and the like, are rectangular.

Figure 5:
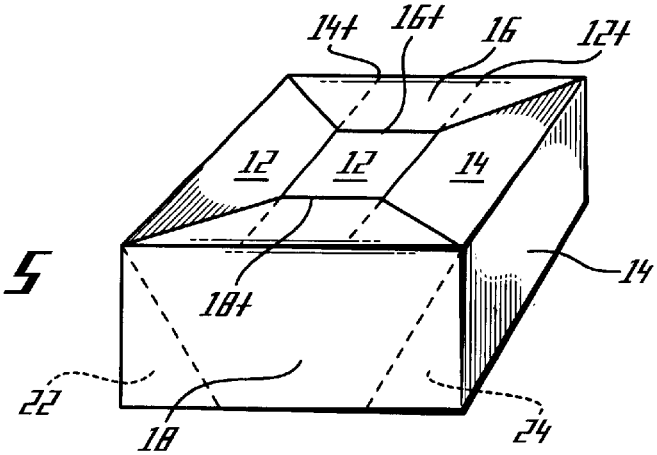
FIG. 5 shows the completely wrapped container of FIGS. 3 and 4, according to a preferred form.

The sheet 10 further comprises first and second end panels 12, 14, connected to the opposite ends of bottom panel 11 at first and second end score lines 38, 34, respectively. The first and second end panels 12, 14 are generally identical mirror images of one another and, therefore, for purposes of brevity only the second end panel 14 will be described in detail. It will be understood that the first end panel 12 is of similar construction to that described. Second end panel 14 preferably comprises a generally rectangular panel 14 having a top edge 14*t*, side edges 14*s* and two flap panels 24, 26. The end panel 14 similarly can comprise a variety of shapes as can bottom panel 11, described above. End panel 14 is designed to approximate the dimensions of an end wall of the box, and further extend slightly more than half the length of the top of the box. In this fashion, when a box is wrapped as shown in FIG. 5, first and second end panels 12, 14 cover the end walls of the box, and slightly overlap on the top of the box.

The flap panels 24, 26 also are generally identical mirror images of one another so only flap panel 24 will be described in detail. It will be understood that flap panels 22, 26 and 28 are of similar construction to that described. Flap panel 24 is preferably triangular, having a base length preferably equal to that of the length of a cut line 42, and a height preferably equal to that of the length of a fold line 44, although flap panel 24 need not be so shaped. Second end panel 18 is separated from flap panel 24 by cut line 42. Thus, flap panel 24 can freely fold about fold line 44. Preferably, fold line 44 has a length that is equal to the height of a corner edge of the gift box or container wrapped by sheet 10. The length of cut line 42 preferably, but not necessarily, equals the length of fold line 44.

The sheet 10 further comprises first and second side panels 16, 18. The first and second side panels 16, 18 connect to the bottom panel 11 at first and second side score lines 36, 32, respectively. The first and second side panels 16, 18 also are similar in construction, and thus, only second side panel 18 will be described in detail. Second side panel 18 is defined by score line 32, cut lines 42, 48, inclined edges 41, 43 and top edge 18*t*. Preferably, cut lines 42, 48 are perpendicular to score line 32 and of equal length. Inclined edges 41, 43 preferably form obtuse angles with cut lines 42, 48, and also preferably have the same length. Inclined edges 41, 43 terminate at top edge 18*t* of second side panel 18, which top edge 18*t* is preferably parallel to score line 32. Side panel 18 is designed to approximate the dimensions of a side wall of the box, and further extend slightly less than half the width of the top of the box. In this fashion, when a box is wrapped as shown in FIG. 5, first and second side panels 16, 18 cover the side walls of the box, but do not overlap on the top of the box.

Angles $\alpha$ determine the coverage of side panels 16, 18 on the top of the box upon folding the wrap. The greater the angle $\alpha$, the larger the surface area of side panels 16, 18.

First and second end score lines 38, 34 are preferably equal in length, which in turn preferably equal the length of the end walls of the gift box or container to be wrapped with the paper. First and second side score lines 36, 32 preferably are the length of the side walls of the gift box.

Figure 2:
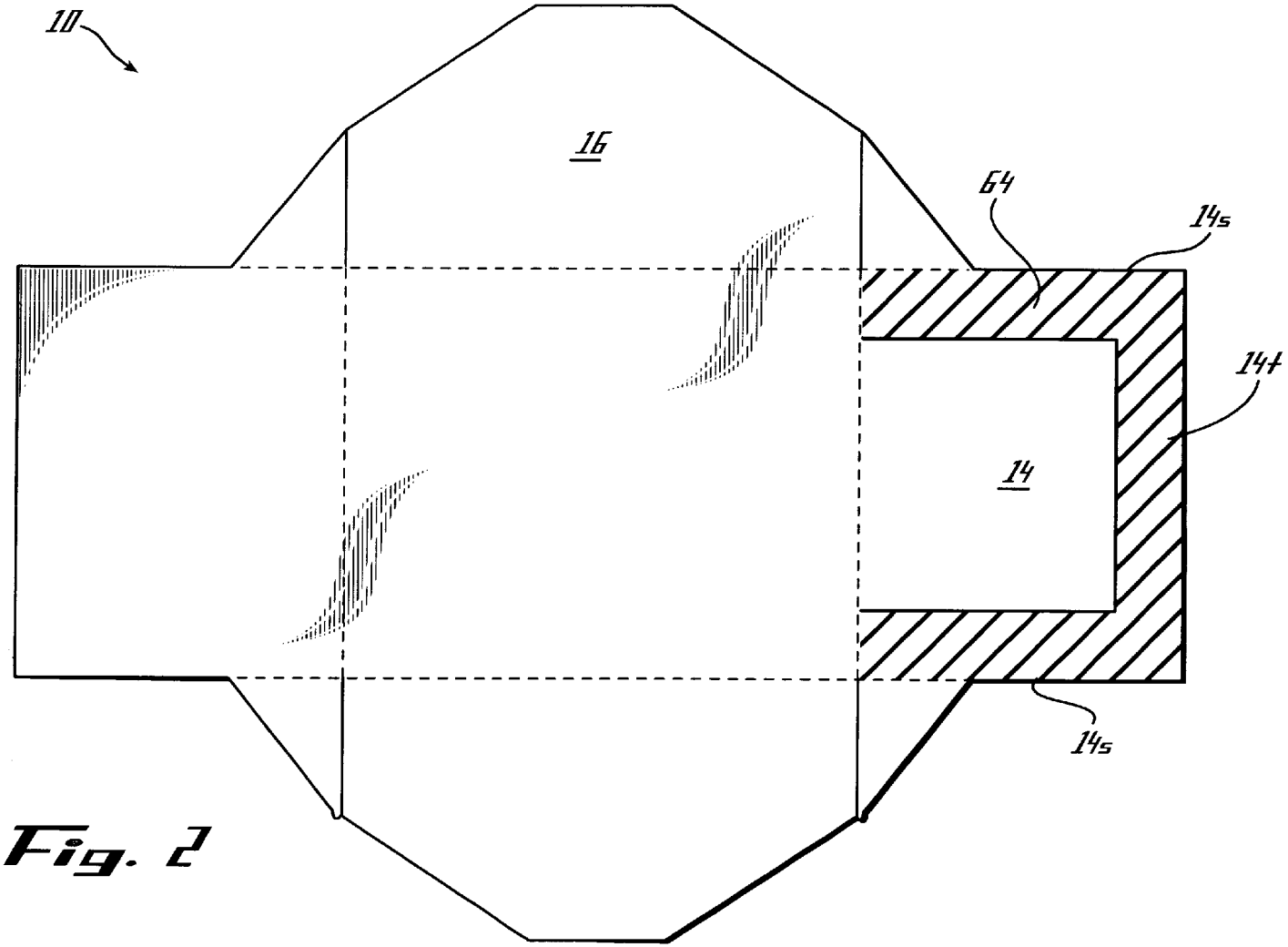
FIG. 2 shows the gift wrap of FIG. 1 incorporating adhesive zones.

The sheet 10 can further comprise an adhesive zone located on one or more of the panels making up sheet 10. An adhesive zone provides a convenient way to releasably or permanently engage the various panels of sheet 10 with The walls of the gift box, or with each other. For example, as shown in FIG. 2, second end panel 14 is illustrated having adhesive zone 64. Adhesive zone 64 is shown as a continuous zone of adhesion around the edges 14*t*, 14*s* of end panel 14. It will be understood that adhesive zone 64 need not form an integral zone 64 but can comprise several discrete zones 64 on end panel 14 so that, upon folding, end panel 14 is releasably or permanently secured to an end wall of the box. It will be understood that the flap panels 24, 26 also can include adhesive zones.

FIG. 2 depicts only representative locations of adhesive zones on the wrapping paper 10. An adhesive zone or zones can be incorporated anywhere on paper 10 such that tape and the like need not be used to secure sheet 10 to the gift box.

Further, the adhesive zones may be located on either face of the wrapping sheet, thus providing engagement between the wrap and the box, or a portion of the wrap and another portion of the wrap, leaving the box free of any deformity that an adhesive zone may inflict.

Preferably, the adhesive zones comprise peel-and-stick assemblies. In one embodiment, the peel-and-stick assemblies incorporate double-sided tape and a passive cover tape. The double-sided tape is first stuck to a portion(s) of the top face of a panel. Then the sticky second side of the tape is covered with a peel away tape that, when peeled off, does not effect the adhesion strength of the second side of the tape.

The wrapping sheet 10 of FIGS. 1 and 2 is designed to completely cover an item. Preferably, the item comprises a square or rectangular box wherein the bottom of the box fits neatly over bottom panel 11, wherein first and second end panels 12, 14 fold over a first and second end wall of the box and continue to fold beyond the end walls of the box over to the top of the box, and wherein first and second side panels 16, 18 are designed to fold over the first and second side walls of the box and continue to fold over onto the top of the box. Although preferably sheet 10 is symmetrical about both a horizontal and vertical line of bi-section, sheet 10 need not be so constructed. If the gift box were not square or rectangular, but alternatively had differently sized end walls, and differently sized side walls, then sheet 10 can be formed incorporating a first end panel 12 larger or smaller than second end panel 14, wherein end panels 12, 14 still provide coverage over the respective walls and top of the gift box, as described above.

In order to provide complete coverage of the outer walls of gift box, the panels of sheet 10 must be so designed so that a panel or several panels of the sheet fold over and fully cover the top of the box. Thus, if first and second end panels 12, 14 do not have sufficient side lengths so that top edges 12*t*, 14*t* overlap on the top of the box, then the first and second side panels 16, 18 must have a height that enables portions of side panels 16, 18 to overlap each other on top of the box.

Wrapping the Container

Figure 3:
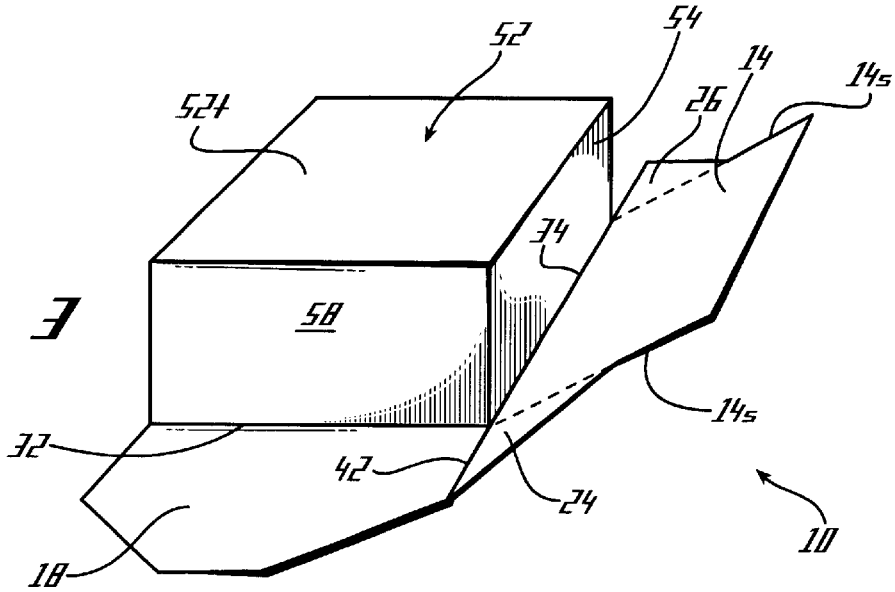
FIG. 3 shows the wrapping sheet of FIG. 1 partially wrapped and assembled around a container according to a preferred form of the present invention.

As shown in FIG. 3, a gift box or container 52 is placed atop sheet 10 over bottom panel 11. It will be understood that sheet 10 can wrap container 52 either from below or above. The container 52 is shown in perspective having side walls 58, end walls 54 and top 52*t*.

Preferably, the length of an end wall 54 is approximately equal to the length of end score line 34, and the height of wall 54 approximately equal to the length of fold line 44. Similarly, the length of a side wall 58 is preferably approximately equal to the length of side score line 32, and the height of wall 58 approximately equal to the height of end wall 54.

Initially, the first and second end panels 12, 14 are folded about their respective score lines 38, 34, wherein a portion of the end panels 12, 14 contact the end walls 54 of the container 52. Specifically illustrated in FIG. 3, second end 14 is folded about score line 34 until end panel 14 covers end wall 54. Preferably, as shown in FIGS. 4 and 5, end panel 14 extends beyond the height of end wall 54 so that upon folding end panel 14 over the top 52*t* of container 52, that portion of end panel 14 contacting the top 52*t* has a length of more than half the length of side score line 32 providing an overlapping relationship with end panel 12.

Figure 4:
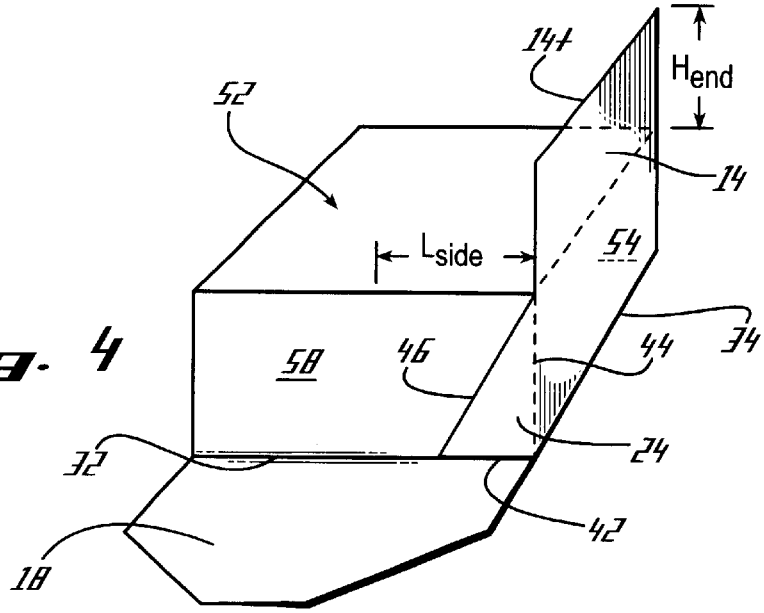
FIG. 4 shows a next step of folding the wrap around the container beyond that shown in FIG. 3.

As shown in FIG. 4, end panel 14 has been folded about score line 34 and up against end wall 54 of container 52. End panel 14 extends beyond the height of end wall 54 an additional height $H_{end}$, which height preferably exceeds the length $L_{side}$, wherein $L_{side}$ equals half the length of score line 32. In this manner, the top edges 12*t*, 14*t* of end panels 12, 14 will overlap one another on the top of the box 52, providing full wrap coverage of the top of the box 52.

Flap 24 then is folded about fold line 44 so that flap 24 lies smoothly against the side wall 58 of container 52. Fold line 44 is shown having a height similar to the height of end wall 58, but it will be understood that fold line 44 need not be equal to the height of side wall 58. The flap panels of sheet 10 are designed to provide the smooth appearance of full coverage of wrap over of the edges of the box 52. Specifically, flap panel 24 need only provide a portion of wrap immediately adjacent fold line 44 over side wall 58. This coverage of flap panel 24 will provide a near seamless, finished look to the wrapped container 52 when side panels 16, 18 are folded against the side walls 58 and top 52*t* of container 52.

FIG. 5 illustrates a completely wrapped container 52. End panel 14 completely covers the adjacent end wall of the box and folds over the top of the box to a point shown as dotted line 14*t*. The flap panels of end panel 14 are then folded against the side walls of the box. End panel 12 is folded against the adjacent end wall of the box and folded over a portion of end panel 14, wherein end panel 12 folds to dotted line 12*t* of end panel 12. The flap panels of end panel 12 are similarly folded against the side walls of the box. The side panels 16, 18 are folded to completely cover the side walls of the box, and then folded over the top of the box. As shown, top edges 16*t*, 18*t* of side panels 16, 18 do not overlap, although they can. Alternatively, the end panels 12, 14 need not overlap if side panels 16, 18 overlap on the top of the box.

Upon the folding of each panel of sheet 10, an adhesive zone on some or all of the panels releasably or permanently fixes that particular panel to a wall of the box, or to a previously folded panel of sheet 10.

As one of the objects of the present invention is to minimize waste wrap material, it is preferable that the surface area of the wrap is only slightly greater than the surface area of the gift box. This limits overlap of the panels of the wrap. This surface area limitation excludes the size of the flaps 22, 24, 26, 28, which flaps are folded under (overlapped) side panels 16, 18.

While the invention has been disclosed in its preferred forms, it will be apparent to those skilled in the art that many modifications, additions, and deletions can be made therein without departing from the spirit and scope of the invention and its equivalents as set forth in the following claims.

What is claimed is:

1. A wrapping paper system comprising:

(a) a sheet of wrapping paper having a top and bottom face, the sheet further incorporating a bottom panel having a first and second ends and first and second sides, first and second end panels extending from the ends of said bottom panel, said end panels having first and second ends and fist and second sides, a triangular flap panel extending from each side of said end panels, and first and second side panels extending from sides of said bottom panel, said side panels having first and second ends and first and second sides; and (b) an object having a bottom, top, side walls and end walls, the sheet of wrapping paper for wrapping the object;

wherein the panels of the sheet of wrapping paper have a cumulative surface area between 100% and 110% of that of the surface area of the object to be wrapped.

2. The wrapping paper system of claim 1, wherein each said side panel of the sheet is bounded by a side of said bottom panel, cut lines, inclined edges and a top edge, a cut line extending between an end of the side of said bottom panel and an end of an inclined edge, and an inclined edge extending between a cut line and an end of the top edge, an obtuse angle ($\alpha$) being formed at each juncture of a cut line with an inclined edge.

3. The wrapping paper system of claim 2, the cut lines being perpendicular to said side of said bottom panel, and The top edge of said side panel being parallel to said side of said bottom panel.

4. The wrapping paper system of claim 3, angle ($\alpha$) being between 100 and 125 degrees.

5. The wrapping paper system of claim 3, wherein said bottom panel is generally rectangular, and wherein said end panels are each a quadrilateral.

6. The wrapping paper system of claim 3, further comprising an adhesive zone for securing a portion of the bottom face of the sheet to the object upon wrapping the object.

7. The wrapping paper system of claim 3, further comprising an adhesive zone for securing a portion of the bottom face of the sheet to a portion of the top face of the sheet upon wrapping the object.

8. A sheet of object wrapping paper having a top and bottom face, the sheet of object wrapping paper for gift-wrapping an object having a bottom, top, side walls, and end walls, the sheet of object wrapping paper comprising:

(a) a bottom panel having first and second ends and first and second sides, (b) first and second end panels extending from ends of said bottom panel, said end panels having first and second ends and first and second sides, said end panels each a quadrilateral;

(c) a triangular flap panel extending from each side of said end panels, having a first, second, and third side, said triangular flap panel containing a fold line on said first side, a cut line on said second side, and said third side constituting the outer edge of said sheet of object wrapping paper;

(d) first and second side panels extending from sides of said bottom panel, said side panels having first and second ends and first and second sides, each said side panel being bounded by a side of said bottom panel, cut lines, inclined edges and a top edge, a cut line extending between an end of the side of said bottom panel and an end of an inclined edge, and an inclined edge extending between a cut line and an end of the top edge, an obtuse angle being formed at each juncture of a cut line with an inclined edge; and (e) an adhesive zone on only one panel selected from the group consisting of end panels and side panels, for securing a portion of the bottom face of the sheet to a portion of the top face of the sheet upon wrapping an object;

wherein the distance between the ends of each end panel distal the bottom panel is greater than the girth of the object around the top, bottom, and side walls of the object and wherein the distance between the top edges of each side panel is less than the girth of the object around the top, bottom, and end walls of the object.

9. The sheet of wrapping paper of claim 8, wherein the panels of the sheet of wrapping paper have a cumulative surface area less than 110% of that of the surface area of an object to be wrapped.

10. The sheet of wrapping paper of claim 9, wherein the panels of the sheet of wrapping paper have a cumulative surface area of between 100% and 110% of that of the surface area of an object to be wrapped.

11. The sheet of wrapping paper of claim 8, angle ($\alpha$) being between 100 and 125 degrees.

12. The sheet of wrapping paper of claim 8, wherein said bottom panel is generally rectangular.

13. A method of gift-wrapping comprising the steps of:

(a) providing a sheet of wrapping paper incorporating:

a bottom panel having first and second ends defined by fold lines and first and second sides defined by fold lines;

first and second end panels extending from ends of said bottom panel, said end panels having first and second ends with said first end defining the outer perimeter of said sheet of wrapping paper, and said second end constituting the fold line shared with the bottom panel, and first and second sides with said first side defining the lower perimeter of the end panel, and said second side defining said upper perimeter of said end panel and defining the fold line for a triangular flap panel;

a triangular flap panel extending from each side of said end panels, each triangular flap panel having a first, second, a third side, said triangular flap panel containing a fold line on said first side, a cut line on said second side, and said third side constituting the outer edge of said sheet of object wrapping paper;

first and second side panels having first and second ends extending from sides of said bottom panel, said side panels having first and second ends and first and second sides, said first end defining the upper boundary of the side panel and said second end defining a fold line between said side panel and said bottom panel, and said first and second sides defining a cut line between said first and second side panels and said triangular flap panels;

and an adhesive zone on only one panel selected from the group consisting of end panels and side panels;

(b) providing an object having a bottom, top, side walls and end walls;

(c) placing the bottom of the object upon the bottom panel of the sheet;

(d) folding the first and second end panels against the end walls of the object;

(e) folding triangular flap panels against the side walls of the object;

(f) folding the first and second side panels along the fold line shared with the bottom panel against the side walls of the object;

(g) folding portions of the first and second end and side panels extending beyond the side and end walls of the object against the top of the object; and (h) securing a portion of the bottom face of the sheet to a portion of the top face of the sheet with the adhesive zone upon wrapping the object;

wherein the panels of the sheet of wrapping paper have a cumulative surface area between 100% and 110% of that of the surface area of the object to be wrapped.

14. The method of gift-wrapping according to claim 13, wherein each said side panel of the sheet is bounded by a side of said bottom panel, cut lines, inclined edges and a top edge, a cut line extending between an end of the side of said bottom panel and an end of an inclined edge, and an inclined edge extending between a cut line and an end of the top edge, an obtuse angle ($\alpha$) being formed at each juncture of a cut line with an inclined edge.

15. The method of gift-wrapping according to claim 14, the cut lines being perpendicular to said side of said bottom panel, and the top edge of said side panel being parallel to said side of said bottom panel.

16. The method of gift-wrapping according to claim 14, the cut lines being perpendicular to said side of said bottom panel, and the top edge of said side panel being parallel to said side of said bottom panel.

17. The method of gift-wrapping according to claim 13, wherein said bottom panel is generally rectangular.

18. The method of gift-wrapping according to claim 13, further comprising and the step of securing a portion of the bottom face of the sheet to a portion of the top face of the sheet.

19. The method of gift-wrapping according to claim 13, further comprising and the step of securing a portion of the bottom face of the sheet to the object.

* * * * *